United States Patent [19]

Caviar

[11] 4,092,505

[45] May 30, 1978

[54] TIMER ARRANGEMENT

[76] Inventor: Lee Caviar, 8216 Walnut, Kansas City, Mo. 64114

[21] Appl. No.: 779,607

[22] Filed: Mar. 21, 1977

[51] Int. Cl.[2] ..... H01H 43/10

[52] U.S. Cl. ..... 200/38 D; 307/141; 239/70

[58] Field of Search ..... 200/38 D, 38 DA, 38 DB, 200/38 DC; 307/141, 141.4, 141.8; 239/66, 70; 137/624.18, 624.20

[56] References Cited

U.S. PATENT DOCUMENTS

| | | | |
|---|---|---|---|
| 3,207,866 | 9/1965 | Hicks | 200/38 DB |
| 3,377,446 | 4/1968 | Davis | 200/38 C |
| 3,736,391 | 5/1973 | Caviar | 200/38 R |
| 3,740,575 | 6/1973 | Bizzoco | 200/38 DA |

*Primary Examiner*—Robert K. Schaefer

*Assistant Examiner*—Morris Ginsburg

*Attorney, Agent, or Firm*—Fishburn, Gold & Litman

[57] ABSTRACT

A program expander for a sprinkler valve timer, alternates a pair of valve selector switches each having a plurality of sprinkler valves connected thereto. The expander includes a star wheel attached to the shaft of a double wafer rotary switching arrangement and a lug on a motor driven timing disk which engages the star wheel once at the end of each revolution thereof, thereby advancing the switching arrangement one position. The expander further includes a bank selector switch which connects valve actuating power alternately to one valve selector switch and then the other, and a disk motor switch which delays disconnecting the disk motor until the end of every other revolution of the disk in cooperation with a motor stop switch actuated by the timing disk and operative to disconnect the disk motor switch at the end of each revolution of the disk.

7 Claims, 8 Drawing Figures

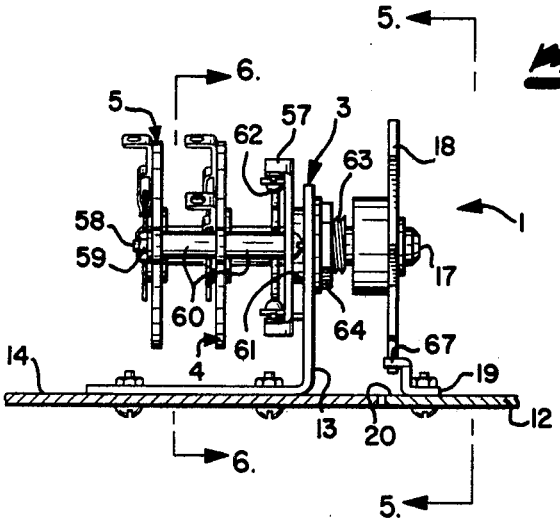
Fig. 4.
Fig. 5.
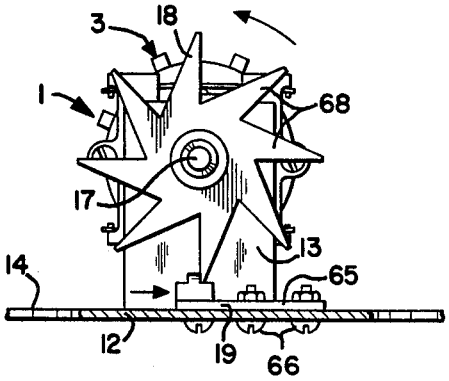
Fig. 6.
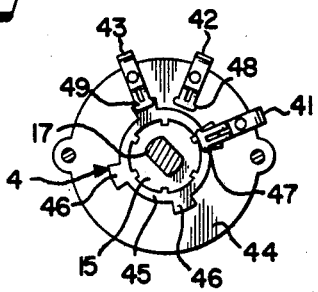
Fig. 7.
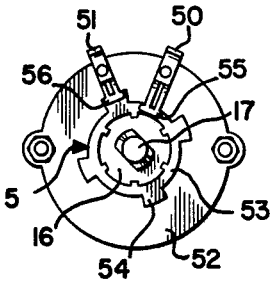
Fig. 8.
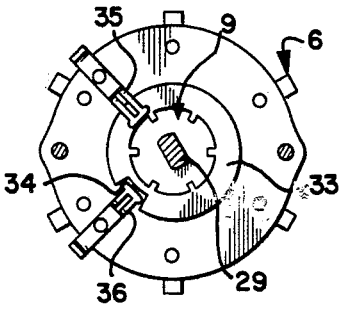

TIMER ARRANGEMENT

The present invention relates to improvements in sprinkler valve timers and more particularly to a switching arrangement for expanding the controlling program of such a timer.

Irrigation sprinkler valve timers are generally designed to actuate a specific number of valves controlling individual sprinkler heads, or sets of heads, in a sprinkler system. In general, the more valves the timer can control, the more expensive the timer is because of the increased number of mechanical and electrical components, larger parts, etc.

In certain timer designs, such as that shown in U.S. Pat. No. 3,736,391, a rotary valve selector switch, rotated by the shaft of a timing disk, connects power in sequence to the valves. Increasing the valve controlling capacity of such a timer is basically a matter of stacking additional rotary switches on the original valve selector switch and keying the rotors of the added switches to the disk shaft. A bank selector switch is then supplied for switching among the banks of sprinkler valves, each bank being controlled by one of the valve selector switches.

It should be appreciated that by this modification for increasing the capacity of the timer, corresponding stations or valves on different banks will have the same time pattern and duration because the timing disk rotates once to cycle through each bank of valves with the station time controls remaining unchanged from cycle to cycle. However, usually this does not seriously detract from the utility of such timers because water distribution can be balanced in relation to individual station time by the choice of the number of sprinkler heads, spacing, pressure regulation, and other means.

Heretofore, approaches for switching between the valve selector swithces included electronic systems employing solid state devices or latching relays cooperating with a microswitch actuated by a cam or lug on the timing disk. Both had serious drawbacks. The electronic methods required expensive biasing and gating circuitry in addition to mechanical or light activated switches. The relay method involved the expense of the relay itself plus the cost of mounting it in association with a properly mounted and adjusted controlling microswitch. In addition, the relay generally employed touching contacts susceptible to malfunction due to dirt and corrosion and the microswitch was difficult to maintain in proper adjustment.

The present invention overcomes the drawbacks of the prior art systems by utilizing a simple, non-critical lug actuated star wheel in association with rotary switches employing wiper contacts which are self-cleaning. The improvements of the present invention enable a reliable sprinkler valve timer, able to control a relatively great number of valves to be manufactured for a relatively low cost.

It is, therefore, the principal objects of the present invention: to provide a simple and reliable timer program expander for switching among a plurality of valve selector switches of a sprinkler valve timer to expand the control capacity thereof; to provide such a timer program expander employing a rotary switch advanced by a star wheel in cooperation with a lug on a rotating timing disk; to provide such a timer program expander requiring a minimum of electrical and mechanical connections to a timer mechanism; to provide such a timer program expander which may be repaired with relative ease in the event of malfunction; to provide such a timer program expander which has reduced tendencies toward malfunctions; to provide such a timer program expander which has application in existing sprinkler timers as well as in newly manufactured timers; to provide such a timer program expander which includes a switch for disconnecting the disk driving motor after the last bank of valves has been cycled through; and to provide such a timer program expander which is economical to manufacture; positive and reliable in operation, and which is particularly well adapted for its intended purpose.

Other objects and advantages of the present invention will becomes apparent from the following description taken in connection with the accompanying drawings wherein are set forth, by way of illustration and example, certain embodiments of the present invention.

FIG. 4 is an enlarged side elevational view of the program expander switch assembly.

FIG. 5 is an enlarged elevational view taken on line 5—5 of FIG. 4 and particularly showing the star wheel and indexing lug.

FIG. 6 is an enlarged sectional view taken on line 6—6 of FIG. 4 and showing the operating components of the bank selector switch.

FIG. 7 is an enlarged view similar to FIG. 6 showing the operating components of the disk motor switch.

FIG. 8 is an enlarged sectional view taken on line 8—8 of FIG. 2 and showing the motor stop switch.

Figure 1:
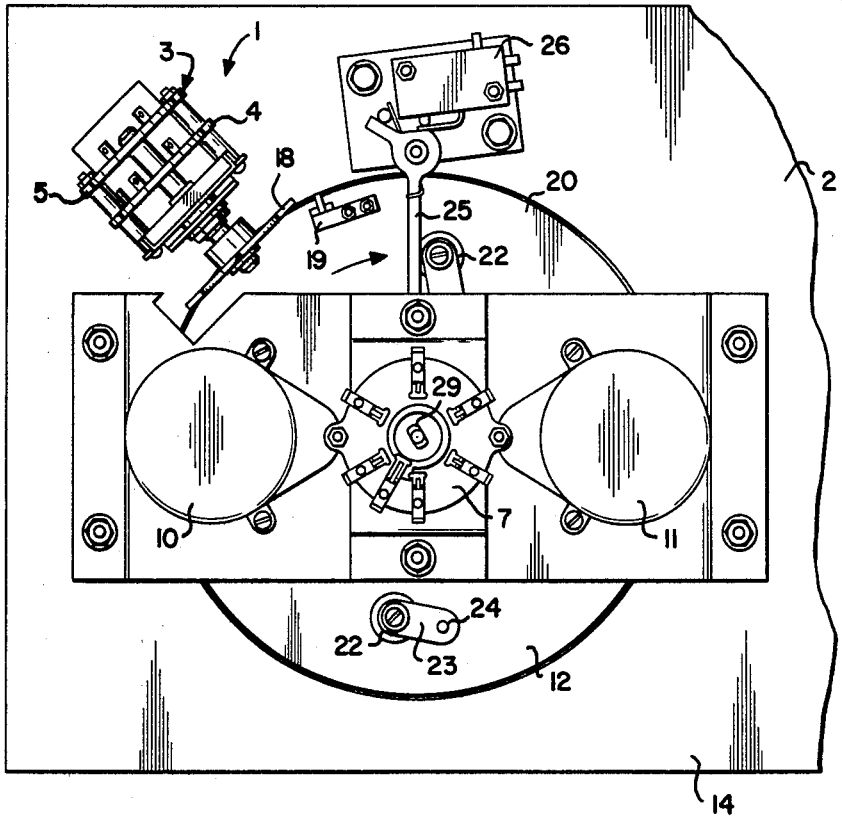
FIG. 1 is a plan view of a sprinkler timer including the program expander switch assembly.

Referring to the drawings in more detail:

The reference numeral 1 generally designates a switching arrangement for expanding the program of a lawn sprinkler timer 2. The switching arrangement 1 is a double wafer rotary switch assembly 3 having a bank selector switch section 4 and a disk motor switch section 5. The bank selector switch 4 chooses between a pair of load or valve selector switches 6 and 7 each having a plurality of sprinkler valves 8 connected thereto. The disk motor switch 5 is connected to and cooperates with a motor stop switch 9 for controlling the motors 10 and 11 employed to drive the timing disk 12 of the timer 2.

The switch assembly 3 includes a bracket 13 for mounting the assembly 3 on the support member or control panel 14 of the timer 2 adjacent the timing disk 12. The switch sections 4 and 5 have respective rotors 15 and 16 mounted on a switch shaft 17 together with a star wheel 18 which turns the rotors 15 and 16 simultaneously upon engagement of the star wheel 18 by a lug 19 mounted on the outer edge 20 of the timing disk 12.

Figure 2:
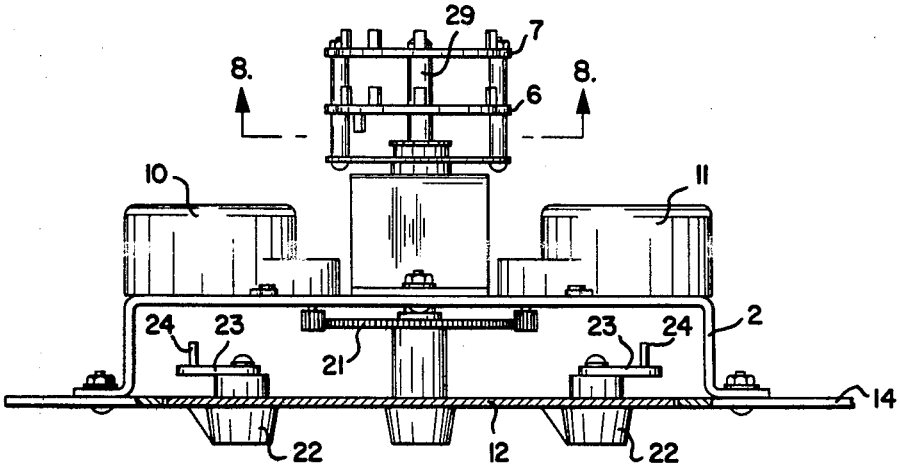
FIG. 2 is a side elevational view of the timer showing a pair of valve selector switches stacked on a shaft keyed to the timing disk.

The timer 2 is a conventional electro-mechanical timer with provisions for controlling the duration of a plurality of events, in particular, the actuation of the sprinkler valves 8. The timing disk 12 is driven through a gearing arrangement 21 by one of two motors: a slow turning motor 10 for timing the sprinkler valves 8 or a faster motor 11 for advancing the disk 12 between positions which activate the valves 8. The timing disk 12 includes a plurality of station or valve time controlling members 22, each having a lever arm 23 and a contact pin 24 (see FIG. 2).

When a time control member 22 is adjusted for a duration of time greater than zero, the respective contact pin 24 is operative to engage a switch lever 25 of a microswitch 26 when the disk 12 has turned to such a position that the control member 22 is adjacent the microswitch 26. The switch 26 includes a normally closed contact 27 connected to the advancing motor 11 and a normally open contact 28 connected to the timing motor 10 (see FIG. 3). Movement of the switch lever 25 by engagement of one of the pins 24 changes the state of the switch 26 thereby stopping the advancing motor 11 and activating the timing motor 10.

The valve selector switch 6 is a rotary switch having the same number of switch positions as the number of time control members 24 on the timing disk 12. The switch 6 has a rotor fixed to a shaft 29 forming the axis of the disk 12. The contacts 30 of the switch 6 are oriented such that a connection is made between the common terminal 31 of the switch 6 and a respective contact 30 coincident with the corresponding time control 24 moving into position to operate the micro-switch 26. At that time, provided the respective time control 24 is adjusted for a time duration, a circuit is completed from a transformer 32 through the common terminal 31 and the respective contact 30 to a specific valve 8 connected thereto.

When one of the time controls 24 is adjusted to zero, the switch 26 is not changed from its normal condition and the disk 12 continues to rotate, driven by the advancing motor 11 until a time control 24 adjusted for a duration of time engages the switch lever 25.

The timer 2 includes a motor stop switch 9 for disconnecting the motors 10 and 11 after one complete revolution of the timing disk. The motor stop switch 9 may be any configuration and is illustrated as a rotary conductive ring 33 having a cutout 34 on the edge thereof and a pair of stationary contacts 35 and 36. The contact 35 makes contact with the ring 33 in all positions thereof while the contact 36 makes contact therewith in all positions except the starting position of the disk 12 in which position the cutout 34 is positioned at the contact 36.

Rotation of the timing disk 12 is initiated by the combined closure of the day switch 37 and the time switch 38 (see FIG. 3), which completes a power circuit to the advancing motor 11. The motor 11 then begins rotating the disk 12 and the conductive ring 33 therewith into engagement with the contact 36, after which the circuit to the motor 11 is maintained until the end of one revolution of the disk 12.

The day and time switches 37 and 38 are actuated respectively by a day wheel and a time wheel (neither shown) which have means for closing the respective switches 37 and 38 at selected times on selected days. The time wheel is driven by the clock motor 39 and has means for advancing the day wheel once every 24 hours.

In order to increase the valve controlling capacity of the timer 2, a second valve selector switch 7, similar to the valve selector switch 6, is stacked onto the switch 6. The switch 7 includes the same number of contacts 40 as the number of contacts 30 of the switch 6 and is operated in a similar manner by rotation of a rotor attached to the disk shaft 29. The valve controlling capacity of the timer 2 is thereby doubled and, obviously, could be tripled or multiplied further, within practical limits, by stacking additional rotary switches of a similar nature onto the disk shaft 29.

With the addition of the valve selector switch 7, a means is required for switching between it and the valve selector switch 6, and a means is required for preventing the motor stop switch 9 from disconnecting the disk driving motors 10 and 11 after one revolution of the disk 12. These requirements are met by the switching arrangement 1 of the present invention. With suitable modifications, the switching arrangement 1 could switch among any number of valve selector switches similar to 6 and 7 and could delay the shutdown of the disk driving motors 10 and 11 until the last bank of valves 8 had been cycled through. For simplicity, however, only two such valve selector switches are described and illustrated.

The bank selector switch 4 is a detented, eight position rotary switch having a common terminal 41 and a pair of bank terminals 42 and 43. The terminals 41, 42, and 43 are mounted on a substantially circular, stationary wafer 44° at 45° angular spacing (see FIG. 6). The rotor 15 is rotatably mounted on the wafer 44 and has a conductive ring 45 fixed thereon. The ring 45 has four radially projecting tabs 46 at 90° angular spacing. The rotor 15 is fixed to and rotates with the shaft 17 of the switching arrangement 1.

The terminals 41, 42, and 43 each have a respective wiper contact 47, 48, and 49. The common terminal wiper 47 is in contact with the conductive ring 45 in all positions of the shaft 17. A connection between the common terminal 41 and one of the bank terminals 42 and 43 is made only when one of the tabs 46 makes contact with the respective wiper contact 48 or 49. The combination of the spacing of the bank terminal contacts 48 and 49 and the spacing of the tabs 46 results in a alternating sequence of connections between the terminals 42 or 43 and the common terminal 41 as the shaft 17 is advanced through the detented positions.

The disk motor switch 5 is similar in construction to the bank selector switch 4, being a detented, eight position rotary switch. However, only two terminals 50 and 51 are required. The terminals 50 and 51 are mounted on a stationary wafer 52. A conductive ring 53 is fixed on the rotor 16, which is mounted for rotation on the wafer 52. The conductive ring 53 has four radially projecting tabs 54 at 90° spacing (see FIG. 7). The terminals 50 and 51 have respective wiper contacts 55 and 56 at 45° angular spacing, the wiper 55 making contact with the ring 53 in all positions of the switch 5 while the wiper 56 makes contact with one of the tabs 54 only in every other detented position of the switch 5.

The switch sections 4 and 5 are mounted in spaced relation to a mounting plate 57 by means of screws 58 and corresponding nuts 59 and spacer sleeves 60. The mounting plate 57 also provides a mounting for a bearing 61 and a detent mechanism 62 for the switching assembly 3. The combined structure of the mounting plate 57, the switch sections 4 and 5, and the screws 58, nuts 59, and spacers 60 is mounted on the bracket 13 by means of the threaded collar 63 of the bearing 61 passing through an aperture (not shown) in the bracket 13 and a nut 64 tightened on the collar 63.

The lug 19 has a base 65 having apertures therein to receive fasteners such as screws 66 therethrough for mounting the lug 19 on the timing disk 12. In the illustrated switching assembly 3, the lug 19 has an horizontal finger 67 which engages the star wheel projections 68 which are movable in a vertical plane as illustrated. It is noted that the star wheel 18 could be of a squirrel cage configuration with horizontally oriented projections, which would then indicate a vertically oriented lug finger.

In either case, some care must be exercised in the relative placement of the switch assembly 3 and the lug 19 to insure that the lug 19 has sufficient, but not excessive, circumferential travel on the disk 12 for advancing the switch sections one position per pass. The use of the detent mechanism 62 increases the allowable travel tolerance of the lug 19. Other factors that affect the engagement of the star wheel 18 by the lug 19 are the shape of the projections 68, the spacing of the lug finger 67 from the surface of the disk 12, and the location of the point of contact by the lug finger 67 on the respective projections 68.

Figure 3:
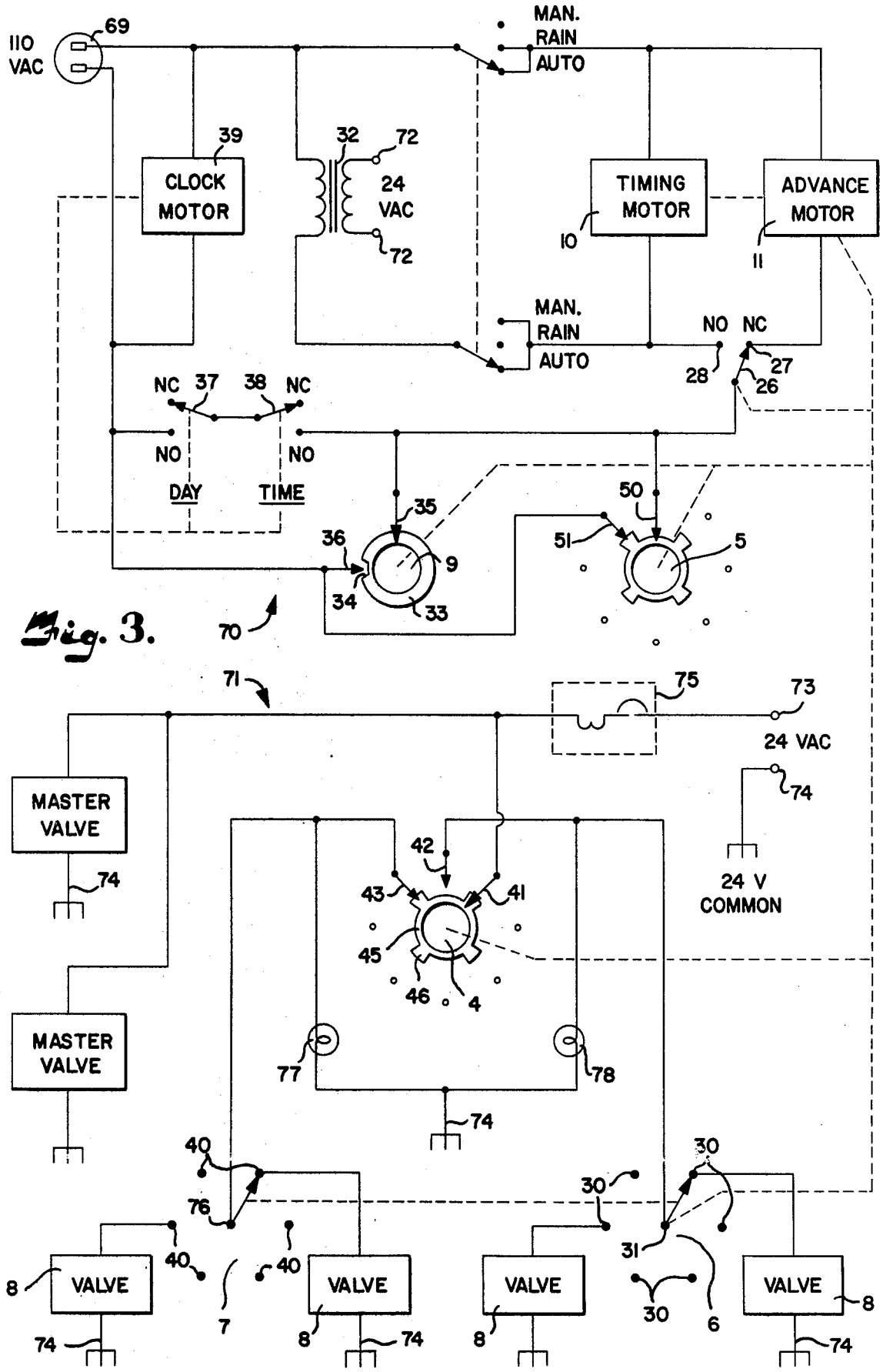
FIG. 3 is a circuit diagram of a sprinkler timer including the program expander switching arrangement.

In the timer 2, the transformer 32 converts the 110 volt line current received at the power socket 69 to 24 volts for operating the valves 8. In FIG. 3, the 110 volt circuit 70 is graphically separated from the 24 volt circuit 71 for convenience and clarity of illustration. The output terminals 72 of the transformer 32 may be considered identical with the input terminals 73 and 74 of the 24 volt circuit 71. The terminal 73 will be referred to as a "hot" power terminal, while the terminal 74 will be referred to as a "common" power terminal.

A resetable circuit breaker 75 is connected to the hot terminal 73 and provides protection for the transformer 32 in the event of an overload. The bank selector switch common terminal 41 is connected to the other side of the circuit breaker 75. The bank terminals 42 and 43 are connected respectively to the common terminal 76 of the valve selector switch 7 and the common terminal 31 of the valve selector switch 6. A pair of panel indicator lights 77 and 78 are connected respectively between the bank terminal 42 and 43 and the common power terminal 74, and indicate the respective valve selector switch 7 or 6 that is activated by the bank selector switch 4.

The disk motor switch 5 is connected in parallel with the motor stop switch 9 in parallel with the series combination of the day and time switches 37 and 38. If any one of the disk motor switch 5, the motor stop switch 9, or the combination of the day and time switches 37 and 38 together is closed, power is supplied to the disk motors 10 and 11. The combined closure of the day and time switches 37 and 38 normally initiates the operation of the motors 10 and 11. The motor stop switch 9 maintains power to the motors 10 and 11 until the end of the revolution of the disk 12, even after the opening of the time switch 38 which remains closed for only about 50 minutes.

The disk motor switch 5 is in one of the closed positions at the end of the first revolution of the disk 12, and the disk 12 makes a second complete revolution during which the switch shaft 17 is advanced one detented position. The end of the second revolution finds the disk motor switch 5 in an open condition. Therefore, in the absence of a combined closure of the day and time switches 37 and 38, the disk driving motors 10 and 11 will be without a complete power circuit and will cease functioning.

The bank selector switch 4 and the disk motor switch 5 are ganged to change positions simultaneously. The timing cycle always begins with the disk motor switch 5 in an "off" condition and with the bank selector switch 4 in a condition wherein the common terminal 41 is connected with the bank terminal 42. The disk 12 is driven through a complete revolution during which the valves 8 connected to the terminals 30 of the valve selector switch 6 are activated one at a time in sequence provided the corresponding time control 22 has been set for a time duration. Just before the end of the first revolution, the lug finger 67 engages one of the star wheel projections 68 and advances the switches 4 and 5 one detented position. This changes the disk motor switch 5 to an "on" condition which allows the disk driving motors 10 and 11 to continue rotating the disk 12 through the second revolution. Also the bank selector switch 4 is changed to a condition wherein the terminal 41 is connected to the bank terminal 43, thereby activating the load selector switch 7.

The disk 12 rotates through the second revolution during which the valves 8 connected to the valve terminals 40 are activated one at a time in sequence. Near the end of the second revolution, the lug finger 67 again engages one of the star wheel projections 68, and the switches 4 and 5 are advanced another detented position. The bank selector switch 4 is returned to the condition of the common terminal 41 being connected to the bank terminal 42, and the disk motor switch 5 is returned to an "off" condition. When the conductive ring 33 of the motor stop switch 9 has rotated such that the cutout 34 is positioned at the terminal 36, the advancing motor 11 is shut down. This shut-down condition remains until both the day and time switches 37 and 38 are again closed.

While certain forms of the present invention have been described and illustrated, it is not to be limited thereto except insofar as such limitations are included in the following claims.

What is claimed and desired to secure by Letters Patent is:

1. A timer program expander for use in an electrical timer having a motor driving a timing disk rotatably mounted on a support member and a plurality of multiposition rotary load selector switches operated by rotation of said disk, each load selector switch having a common terminal making connection one at a time in sequence to each of the load terminals thereof, said timer program expander comprising:

(a) a bracket mounted on said support member;
(b) an axle rotatably mounted on said bracket;
(c) a star wheel fixed on said axle, said star wheel having a plurality of equally spaced projections;
(d) a lug mounted on said timing disk and operative upon engagement with said star wheel to rotate said axle; and
(e) bank selector switch means having a common terminal and a plurality of bank terminals equal to the number of said load selector switches, each of said bank terminals being connected to one of said load selector switch common terminals, said bank selector switch means being operative upon rotation of said axle to make connection one at a time in sequence between said bank selector switch means common terminal and one of said bank terminals.

2. The timer program expander as set forth in claim 1 wherein:

(a) said bank selector switch means is rotary multiposition bank selector switch having switching components operated by rotation of said axle; and
(b) said star wheel has a number of projections equal to the number of positions of said bank selector switch.

3. The timer program expander as set forth in claim 1 wherein said timer has a pair of said load selector switches, said timer program expander including:

(a) said star wheel having eight equally spaced projections; and (b) said bank selector switch means being a detented eight position rotary switch having a pair of said bank terminals and contact means whereby connection between said bank selector switch means common terminal and each of said bank terminals is alternated in succeeding positions as said bank selector switch is advanced.

4. The timer program expander as set forth in claim 3 wherein said bank selector means comprises:

(a) said pair of bank terminals each having a wiper contact and each being connected to one of said load selector switch common terminals, said bank terminal wiper contacts having an annular spacing of an odd multiple of 45°;

(b) said bank selector switch means common terminal having a wiper contact;

(c) a conductive ring mounted on a rotor fixed to said axle, said ring having four radial tabs at 90° angular spacing;

(d) said ring making contact with said bank selector switch common terminal contact in all positions of said axle; and (e) one of said tabs making contact alternately with one of said bank terminal contacts and then the other in succeeding detented positions of said bank selector switch.

5. The timer program expander as set forth in claim 1 wherein said timer includes motor stop switch means for disconnecting said motor driving said disk at the end of each revolution of said disk, said timer program expander including:

(a) a rotary disk motor switch having switching components operated by rotated of said axle and having the same number of switch positions as said bank selector switch means;

(b) said disk motor switch being connected to said motor stop switch means in such a manner that both said motor stop switch means and said disk motor switch must be in an open condition to disconnect said motor driving said disk; and (c) said disk motor switch open condition coinciding with the connection between said bank selector switch means common terminal and the last of a sequence of said bank terminals.

6. The timer program expander as set forth in claim 5 wherein said timer includes a pair of said load selector switches, said timer program expander including:

(a) said rotary disk motor switch being a detented eight position rotary disk motor switch operated by rotation of said axle; and (b) said disk motor switch including contact means whereby said disk motor switch alternates between a closed condition and an open condition in succeeding positions of said disk motor switch with said open condition coinciding with said bank selector switch means making a connection between the common terminal thereof and the second of a sequence of a pair of said bank terminals.

7. The timer program expander as set forth in claim 6 wherein said disk motor switch contact means includes:

(a) a pair of terminals having wiper contacts and being operatively connected to said motor stop switch means;

(b) a conductive ring mounted on a rotor fixed to said axle, said ring having radial tabs at 90° angular spacing;

(c) one of said wiper contacts making contact with said ring in all positions of said disk motor switch; and (d) one of said tabs making contact with the other of said wiper contacts in every other detented position of said disk motor switch.

* * * * *